US005893238A

United States Patent [19]

Peacock et al.

[11] Patent Number: 5,893,238

[45] Date of Patent: Apr. 13, 1999

[54] INFLATABLE TENT CONSTRUCTION

[76] Inventors: Ralph Peacock; Mary Peacock, both of 7965 S. County Rd. 800 West, Paris Crossing, Ind. 47270

[21] Appl. No.: 09/057,888

[22] Filed: Apr. 9, 1998

[51] Int. Cl.[6] ..... E04G 11/04; E04H 15/00

[52] U.S. Cl. ..... 52/2.18; 52/2.19; 52/2.24; 135/87; 135/125; 135/137

[58] Field of Search ..... 52/2.18, 2.19, 52/2.24; 135/87, 125, 137, 908

[56] References Cited

U.S. PATENT DOCUMENTS

| | | | |
|---|---|---|---|
| 3,540,170 | 11/1970 | Flowers | 52/2.19 |
| 3,840,919 | 10/1974 | Middleton . | |
| 4,109,424 | 8/1978 | Block . | |
| 4,197,681 | 4/1980 | Holcombe . | |
| 4,251,959 | 2/1981 | Hsu | 52/2 |
| 4,271,642 | 6/1981 | Karr . | |
| 4,384,435 | 5/1983 | Polise et al. | 52/2 |
| 4,901,481 | 2/1990 | Seely, Jr. | 52/2 |
| 5,007,212 | 4/1991 | Fritts et al. | 52/2.18 |
| 5,487,400 | 1/1996 | Dawkins | 135/87 |

*Primary Examiner*—Carl D. Friedman
*Assistant Examiner*—Brian E. Glessner
*Attorney, Agent, or Firm*—Henderson & Sturm

[57] ABSTRACT

An inflatable tent construction 10 including an upper wall unit 12 and a lower wall unit 13 having a plurality of vertically aligned inflatable tubular chambers 33 and 40 wherein the lower wall unit 12 is operatively connected to a floor unit 11 and provided with a plurality of tent opening units 14. A plurality of inflatable circular rings 20, 32 and 33 encircle the periphery of the floor unit 11, the lower wall unit 13, and the upper wall unit 12, respectively.

11 Claims, 1 Drawing Sheet

INFLATABLE TENT CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of inflatable structures in general, and in particular to an inflatable tent constructions.

2. Description of Related Art

As can be seen by reference to the following U.S. Pat. Nos. 3,840,919; 4,109,681; 4,197,681; and 4,271,642, the prior art is replete with myriad and diverse inflatable wall tent constructions.

While all of the aforementioned prior art constructions are more than adequate for the basic purpose and function for which they have been specifically designed, they are uniformly deficient with respect to their failure to provide a simple, efficient, relatively rigid, and extremely structurally sound inflatable wall tent construction.

As anyone who has spent any extensive time camping is all too well aware, usually the most burdensome chore associated with this pastime is the act of pitching or setting up the tent at the beginning of the trip and the act of breaking down the tent at the end of the trip.

As a consequence of the foregoing situation, there has existed a longstanding need for a new and improved type of inflatable tent construction that employs concentric rings of different sized inflatable chambers to form a rigid and stable generally hemi-spherical tent wall construction and the provision of such a construction is a stated objective of the present invention.

BRIEF SUMMARY OF THE INVENTION

Briefly stated, the inflatable tent construction that forms the basis of the present invention comprises in general a floor unit, an upper wall unit, a lower wall unit, and a plurality of wall opening units formed in the lower wall unit.

As will be explained in greater detail further on in the specification, the upper and lower wall units each comprise a plurality of vertically aligned inflatable tubular chambers having horizontally arrayed inflatable rings disposed on both their tops and bottoms. The upper and lower wall units share an intermediate inflatable ring.

In addition, the floor unit shares the lower inflatable ring of the lower wall unit, and comprises a plurality of horizontally arrayed inflatable tubular chambers arranged in a parallel fashion. The horizontally arrayed inflatable tubular chambers are selectively inflatable to provide a raised head cushion support on opposite ends of the tent floor unit.

Furthermore, the lower wall unit is provided with the plurality of wall opening units which comprise a plurality of window members and at least one portal member all of which are provided with removable screen elements and weather closure elements.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
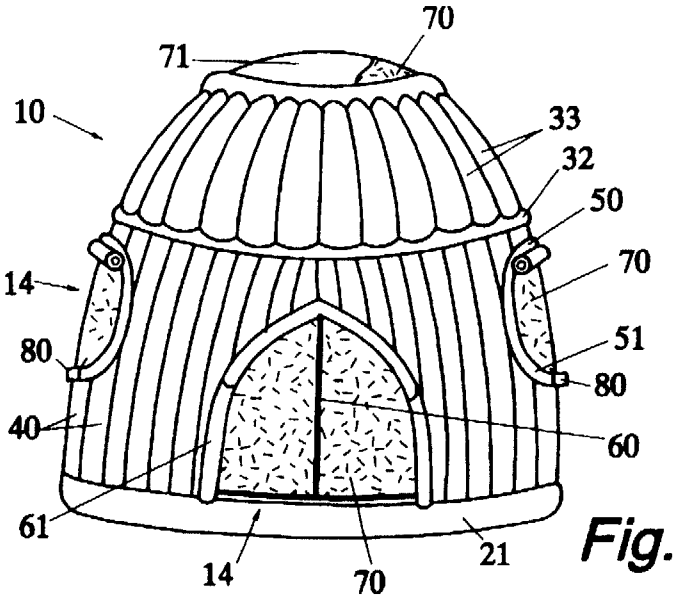
FIG. 1 is a perspective view of the inflatable tent construction with the front closure in place.
Figure 2:
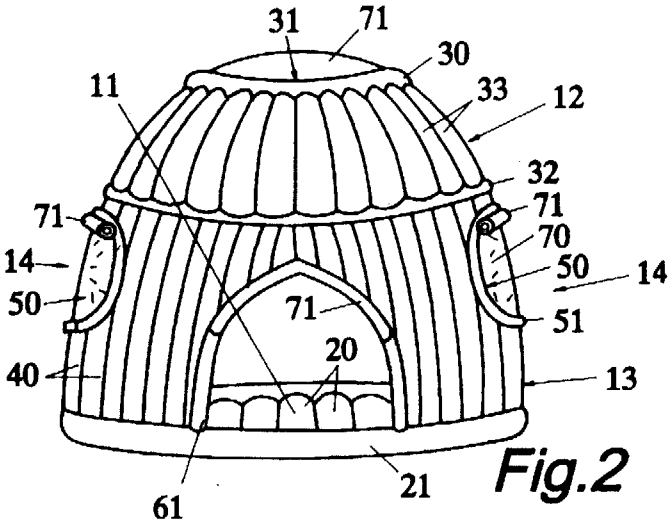
FIG. 2 is a perspective view of the inflatable tent construction with the front closure retracted.

As can be seen by reference to the drawings, and in particularly to FIG. 1, the inflatable tent construction that forms the basis of the present invention is designated generally by the reference number 10. As shown in FIG. 2, the tent construction 10 comprises in general a floor unit 11, an upper wall unit 12, a lower wall unit 13 and a plurality of wall opening units 14 formed in the lower wall unit 13. These units will now be described in seriatim fashion.

Figure 4:
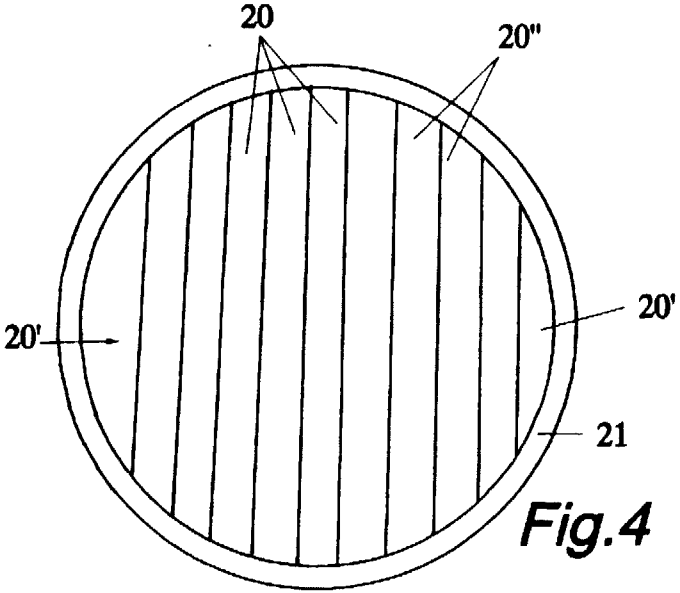
FIG. 4 is a top plan view of the floor unit.

As shown in FIGS. 2 and 4, the floor unit 11 comprises a plurality of inflatable interior floor chambers 20 aligned in parallel fashion and horizontally disposed within an enlarged diameter exterior inflatable circular base ring 21. The base ring 21 is inflatable independent of the floor chambers 20. Furthermore, the floor chambers 20 may either be inflated as a single pneumatically interconnected unit, or selectively inflated in groups, such that the smaller length floor chambers 20' on each end of the floor unit 11 may serve as inflatable pillows while the larger intermediate floor chambers 20" may function as an air mattress.

It should also be noted that in most instances, the intermediate floor chambers 20" will be under inflated to allow people to walk in the interior floor chambers 20 in the normal fashion. However, when one or more people spread their body weight over a larger surface area of the interior floor chambers 20, there will be sufficient air pressure to keep the opposite walls of each inflatable chamber 20 from contacting one another.

Figure 3:
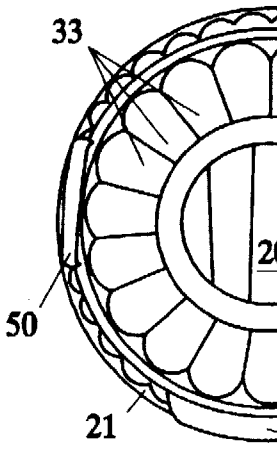
FIG. 3 is a top plan view of the tent construction.

Turning now to FIGS. 1 through 3, it can be seen that the upper inflatable wall unit 12 comprises in general, an upper reduced diameter horizontally disposed inflatable circular ring 30 which defines a central opening 31 in the top of the generally hemispherically shaped inflatable tent construction 10, an intermediate diameter horizontally disposed inflatable circular ring 32 and a plurality of enlarged width vertically aligned inflatable tubular chambers 33 which extend between the upper inflatable ring 30 and the intermediate inflatable ring 32. The enlarged tubular chambers 33 are pneumatically interconnected with one another in selected groups or in serial fashion, and arrange in a generally flower petal fashion around the upper inflatable circular ring.

In the preferred embodiment of the invention illustrated in the drawings, the upper 30 intermediate 32 and the base 21 rings are independently inflatable. However, there may be certain instances wherein the upper 30 and intermediate 32 inflatable rings are pneumatically associated with their associated vertical tubular chambers 33 and 40.

As can best be seen by reference to FIGS. 1 and 2, the lower wall unit 13 comprises a plurality of reduced width vertically aligned inflatable tubular chambers 40 which extend between the base ring 21 and the intermediate ring 32. The inflatable tubular chambers 40 are pneumatically interconnected with one another either in select groups or in series fashion.

As can also best be seen by reference to FIGS. 1 and 2, the lower wall unit 13 is provided with a plurality of wall opening units 14 which comprise a plurality of window members 50 and at least one portal member 60. The window members 50 are defined by vertically disposed inflatable rings 51 and the at least one portal member 60 is defined by an inflatable arch 61.

In addition, the window members 50, the portal member 60, and the upper inflatable circular ring 30 are provided with screen elements 70 and removably cover elements 71 which are operatively engaged with their respective structures by strips of hook and loop fasteners 80, in a well recognized fashion, to provide protection during inclement weather or the like.

As can also be seen by reference to FIGS. 2 and 3, the interior floor chambers 20 are aligned generally perpendicular to the opening in the portal member 60 such that the pillow chambers 20' are offset from the portal member 60 to facilitate entry into and exit from the tent construction 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

We claim:

1. An inflatable tent construction comprising:

a reduced diameter horizontally disposed upper inflatable ring;

an enlarged diameter horizontally disposed inflatable lower base ring;

an intermediate diameter horizontally disposed inflatable intermediate ring;

a first plurality of vertically aligned inflatable tubular chambers extending between said upper inflatable ring and said intermediate inflatable ring;

a second plurality of vertically aligned inflatable tubular chambers extending between said inflatable base ring and said inflatable intermediate ring; and a plurality of openings formed in said second plurality of vertically aligned inflatable tubular chambers.

2. The inflatable tent construction as in claim 1 wherein said upper inflatable ring defines a central opening in the top of said tent construction.

3. The inflatable tent construction as in claim 2 wherein said central opening is dimensioned to receive a cover element.

4. The inflatable tent construction as in claim 1 wherein said plurality of openings comprise a tent portal member and at least one window member.

5. The inflatable tent construction as in claim 1 wherein said plurality of openings comprise a pair of window members and at least one portal member.

6. The inflatable tent construction as in claim 1 wherein said lower inflatable base ring is provided with a plurality of horizontally disposed interior floor chambers.

7. The inflatable tent construction as in claim 6 wherein said interior floor chambers are aligned in a parallel fashion.

8. The inflatable tent construction as in claim 1 wherein said plurality of openings are provided with a like plurality of screened elements.

9. The inflatable tent construction as in claim 8 wherein said plurality of screened elements are each provided with retractable cover elements.

10. The inflatable tent construction as in claim 1; wherein, the first plurality of vertically aligned inflatable chambers have a first uniform size and the majority of the second plurality of vertically aligned inflatable chambers have a second uniform size; wherein, said first and second uniform sizes are different.

11. The inflatable tent construction as in claim 10; wherein the second plurality of vertically aligned inflatable chambers have a reduced width relative to said first plurality of vertically aligned inflatable chambers.

* * * * *